United States Patent [19]

Arnheiter et al.

[11] 4,346,135

[45] Aug. 24, 1982

[54] FIBROUS REINFORCING MEANS FOR CEMENTITIOUSLY AND BITUMINOUSLY BOUND COMPOSITE STRUCTURES AND COATINGS

[75] Inventors: Adolf Arnheiter, St. Gallen; Rudolf Enzler, Lichtensteig, both of Switzerland

[73] Assignee: Arnheiter AG, Forta-Seilwerke, St. Gallen, Switzerland

[21] Appl. No.: 139,727

[22] Filed: Apr. 14, 1980

[30] Foreign Application Priority Data

May 3, 1979 [CH] Switzerland ..... 4153/79

[51] Int. Cl.[3] ..... B32B 5/04

[52] U.S. Cl. ..... 428/212; 428/22; 428/247; 428/255; 428/489; 428/703

[58] Field of Search ..... 428/225, 247, 255, 256, 428/257, 258, 259, 489, 703, 212

[56] References Cited

U.S. PATENT DOCUMENTS

| | | | |
|---|---|---|---|
| 4,021,258 | 5/1977 | Uogaeshi | 106/99 |
| 4,133,928 | 1/1979 | Riley et al. | 428/255 |
| 4,159,361 | 6/1979 | Schupack | 428/247 |

*Primary Examiner*—James J. Bell

*Attorney, Agent, or Firm*—Charles E. Brown

[57] ABSTRACT

A fibrous reinforcing means for cementitiously and bituminously bound composite structures and coatings comprises at least two various groups of fibrous articles. At least one of the groups consists of fibrous articles in the form of a closed filamentary net. The fibres thereof are resilient. They are added to the material to be mixed in a condensed shape such to expand during the mixing step of the preparation of the composite structure.

6 Claims, 5 Drawing Figures

FIBROUS REINFORCING MEANS FOR CEMENTITIOUSLY AND BITUMINOUSLY BOUND COMPOSITE STRUCTURES AND COATINGS

BACKGROUND OF THE INVENTION

1. Field of the Invention

The present invention relates generally to articles intended for the reinforcement of cementitiously bound structures such as e.g. reinforced concrete and to bituminously bound structures and coatings such as road pavements.

2. Description of the Prior Art

The prior art is generally cognizant of applying fibres or filaments as a means for reinforcing and improving the strength of construction materials. Presently, the following fibres in form of monofilaments are considered as being specifically suitable for above mentioned application: steel fibres, glass fibres, plastic fibres (e.g. polypropylene, polyethylene, polyamide, aramide (highly aromatic polyamide), polyvinyl-chloride (PVC)), carbon fibres, asbestos fibres, natural fibres.

Quite obviously the distribution of such fibres across the cross section of the reinforced structure must be uniform or homogeneous such as to suitably improve the formation and arrangement of the cracks or fissures formed by the reinforcing fibres in such structures. However, the known fibres feature generally the disadvantage of agglomorating or balling up in the structure which is being reinforced therewith. Such agglomorating is due to e.g. an electrostatic charging of the fibres or due to gravitational forces. Accordingly no even or uniform distribution of the fibres within the structure is achievable. Attempts to overcome mentioned drawback encompassed a relatively high dosing of fibres relative to the cross-sectional area and further to follow special procedures when adding the fibres to the matrix material such as the so-called trickling of the fibres into the matrix material. Such procedure can be successfully followed in laboratories. It is, however, extremely complicated and is hardly or not at all suitable for a practical application at work site. Accordingly there hardly exist any economically acceptable solutions regarding the production of fibre reinforced composites.

SUMMARY OF THE INVENTION

Hence, it is a general object of the invention to provide a fibrous reinforcing means which allows an economic and practically executable production of fibre reinforced structures.

Now, in order to implement this and other objects which will become readily apparent as the description proceeds, the fibrous reinforcing means of this development is manifested by the features of providing at least two different groups of fibre forms, whereby at least one of said groups features the form of a closed fibre net having spring elastic fibres and which comprises a compacted shape prior to its adding into the matrix material.

BRIEF DESCRIPTION OF THE DRAWINGS

The invention will be better understood and objects other than those set forth above, will become apparent when consideration is given to the following detailed description thereof. Such description makes reference to the annexted drawings wherein.

DETAILED DESCRIPTION OF THE PREFERRED EMBODIMENTS

It has been set forth above that one of the difficulties present in the art of fibrous reinforcements for e.g. concrete is that in a practical application there exists hardly an economical procedure which allows a uniform distribution of the fibres across the cross section of the structure to be reinforced such to obtain among other things a uniform generation of cracks. The reason thereof is that the individual fibres tend to cling to each other, to agglomorate or ball up due to electrostatic forces of attraction or that due to other technical influences such as e.g. differing specific gravity the fibres descend or sink down to the bottom of the just cast body or rise and float at the surface of such cast body again forming agglomorations.

In order now to distribute the fibrous reinforcing elements consisting of individual fibres uniformly across the cross section of the composite structure they initially are utilized in accordance with the invention together with a specifically shaped and arranged reinforcing element which now will be described.

Figure 1:
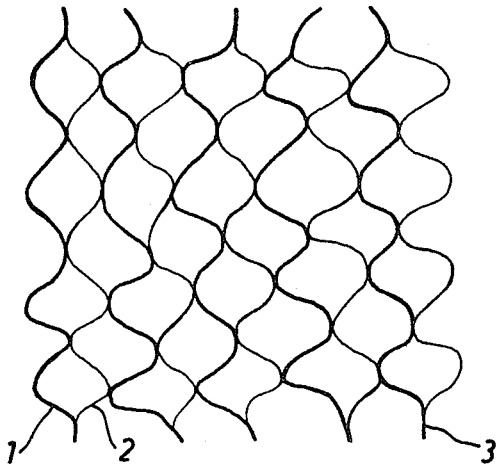
FIG. 1 is a view of a reinforcing element in form of a net of plastic fibres, drawn in its shape after being mixed with the matrix material to be reinforced.
Figure 2:
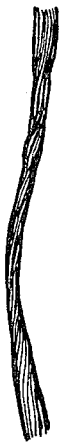
FIG. 2 is a view of the reinforcing element of FIG. 1 in its condensed condition and shape prior to the adding thereof to the matrix material.

This reinforcing element comprises the shape of a closed fibre net made of polypropylene and is shown in FIGS. 1 and 2. This fibre net is an integral one-piece structure, whereby the drawn embodiment comprises two different fibre thicknesses. Thereby first fibres 1 are connected to each other by means of second fibres 2, whereby the cross-sectional area of the second fibres 2 is less than the cross-sectional area of the first fibres 1. These fibrous nets if now added to the aggregates to be mixed tend also to adhere to one another specifically due to the mixing operation e.g. if a static charging of the fibres occurs such that no uniform distribution of the reinforcing fibres in the concrete proper forming the matrix material would be achieved. However, because the fine polypropylene fibres are spring elastic, i.e. have a spring quality e.g. all second fibres 2 act as springs which keep the first fibres 1 at a distance from each other while overcoming the mutual attraction forces such that a self-distribution of the fibres results in the matrix material or concrete, respectively. Further, some individual end sections 3 of the fibres curl or loop around the grains of the aggregates used for the preparation of the concrete such to act additionally against the bunching up or agglomorating of the fibre net during the mixing operation or immediately thereafter, e.g. in the poured concrete. Obviously the opened net-like reinforcing member does not describe in its final form a flat plane such as drawn in FIG. 1 and is rather deformed in all three dimensions of space.

The shape or form of the net-like reinforcing element prior to its adding to the aggregates, i.e. its ready-to-use form is shown in FIG. 2. The reinforcing element is twisted similarly to a cord, whereby the number of turns or twists, respectively, is predetermined. In order to produce the reinforced structure the compacted or condensed, respectively, net-like reinforcing element having the shape as shown in FIG. 2 is charged together with the aggregates into the concrete mixing machine and thereafter the mixing is performed according to the generally known procedure and especially during the standard time span. During this time span the cord-like shape of the reinforcing element opens or untwists, respectively, by itself and after expiration of the mentioned time span a three-dimensionally distributed net shape is formed. It is a known fact that the time span during which the mixing for the preparation of concrete must be performed is a standardized figure. Accordingly, the number of twists of the original cord section can be exactly predetermined in order to arrive at a three-dimensional net after expiration of the mixing. Should namely the net not be completely opened upon the ending of the mixing procedure, its effect regarding the reinforcement is reduced. Should the net reach its completely open shape prior to the termination of the standardized mixing time span, the net will be torn during the balance of the mixing time span and thus would arrive at a condition similar to the known split fibres and accordingly its effect regarding the reinforcement would again be reduced. The condensed shape of the ready-to-use reinforcing element such as shown in FIG. 2 allows now the practical use of the reinforcing element at job site because no additional means are necessary for adding the reinforcing elements to the aggregates for mixing the concrete (specifically it is not necessary to trickle the elements into the mixer) and, furthermore, no additional checking of time spans is necessary. It must be noted that the shown ready-to-use condensed shape of the reinforcing element, namely the twisted cord, is one possible although preferred embodiment only. The condensed shape may be attained by means of other forms and another embodiment comprises water soluble binding agents for keeping the condensed shape together.

It has been mentioned above that the fibre reinforcing element must meet the demand of a uniform distribution thereof across the cross section of the reinforced structure because the formation or arrangement of cracks must be uniformly distributed.

Such uniform distribution is now practically achievable by utilizing such self-distributing net-shaped reinforcing elements, and this together, i.e. in combination with other known reinforcing fibres in form of individual fibres such as e.g. fibres made of glass, steel, plastic materials, carbon, asbestos, natural fibres and so on. Thereby one or several of mentioned fibre types may be used together with the net-shaped reinforcing element, whereby the length of the individual fibres of the same type can vary, such as will be explained in detail further below. If the reinforcing elements having mentioned shapes of individual fibres are added together with the condensed fibre net into the material to be mixed, whereby the fibre net is self-distributing during the mixing, such individual fibres will be uniformly dispersed by the action of the net opening itself during mixing. In addition to this these nets prevent the balling up, clinging together, etc. of the individual fibres because the latter are purely mechanically prevented by the nets to bunch together. Accordingly, the individual fibres are guided by the nets such that a uniform distribution of the individual fibres and obviously also of the net-shaped fibres throughout the reinforced concrete structure is achieved.

There will be now described an example encompassing reinforced concrete having a combination of net-like reinforcing elements of propylene together with steel fibres.

Firstly, a test specimen of not reinforced concrete has been made. This concrete specimen was tested and showed a bending strength of about 32 kp/cm$^2$ (455.04 lbs/sq. in.) which is a general average figure for concrete. Thereafter, a further concrete specimen was made, to which a theoretically calculated optimal amount of steel fibres, namely 144 kg (317.52 lbs) was added. Thereafter the bending strength of this exclusively steel fibre reinforced concrete specimen was measured, amounting to about 68 kp/cm$^2$ (966.96 lbs/sq. in.). Accordingly, the steel fibres caused an improvement of the bending strength of about 36 kp/cm$^2$ (511.92 lbs/sq. in.). Thereafter a further concrete specimen was made, to which there was added a calculated optimal amount of 1 kg (2.205 lbs) of the net-shaped polypropylene fibre reinforcing elements. The bending strength of this concrete specimen was measured and amounted to 36 kp/cm$^2$ (511.92 lbs/sq. in.). Accordingly, the bending strength of the concrete specimen having exclusively the fibre-net reinforcement improved by 4 kp/cm$^2$ (56.88 lbs/sq. in.).

Accordingly, the use of plastic fibre nets together with steel fibres would lead to a theoretically calculated improvement of the bending strength by 36+4=40 kp/cm$^2$ (511.92+56.88=568.80 lbs/sq. in.); accordingly, a concrete specimen incorporating both of above reinforcing elements would show a bending strength of 32+40=72 kp/cm$^2$ (455.04+568.80=1023.84 lbs./sq. in.).

However, the inventive utilization of steel fibres together with fibre nets results, due to the distributing action of the fibre nets, in an unexpected, considerable improvement of the bending strength.

A further concrete test specimen was produced, which specimen was reinforced by 144 kg (313.52 lbs) of the above steel fibres and 1 kg (2.205 lbs) of the above fibre nets and again its bending strength was measured. The measured figure was about 100 kp/cm$^2$ (1422 lbs/sq. in.) which is incomparably higher in comparison with the theoretically calculated figure of 72 kp/cm$^2$ (1023.84 lbs/sq. in.).

These test results are listed together with other measured data in the following tabulation.

| | | unreinforced concrete | concrete reinforced by steel fibres | concrete reinforced by fibre nets | concrete reinforced by steel fibres and fibre nets |
|---|---|---|---|---|---|
| Bending | μ | 32.88 | 68.83 | 36.38 | 100.96 |
| strength | G | ±2.06 | ±9.37 | ±2.67 | ±6.33 |
| βB2 [Kp/cm$^2$] | V | 6.27% | 13.61% | 7.35% | 6.27% |
| cleavage | μ | 36.97 | 57.31 | 34.79 | 59.38 |
| strength | G | ±3.53 | ±6.60 | ±2.49 | ±7.85 |
| βS2 [Kp/cm$^2$] | V | 9.55% | 11.52% | 7.16% | 13.22% |
| crushing | μ | 470.33 | 624.30 | 476.85 | 588.88 |
| strength | G | ±42.45 | ±16.49 | ±36.57 | ±10.53 |
| βW 2S [Kp/cm$^2$] | V | 9.03% | 2.64% | 7.67% | 1.79% |
| gross density | μ | 2.322 | 2.443 | 2.323 | 2.423 |
| of raw | G | ±0.005 | ±0.011 | ±0.017 | ±0.007 |
| concrete | V | 0.22% | 0.45% | 0.75% | 0.27% |

-continued

| | | unreinforced concrete | concrete reinforced by steel fibres | concrete reinforced by fibre nets | concrete reinforced by steel fibres and fibre nets |
|---|---|---|---|---|---|
| gross density of solid concrete (28 days) | μ | 2.300 | 2.390 | 2.30 | 2.40 |
| | G | ±0.002 | ±0.003 | ±0.01 | ±0.003 |
| | V | 0.09% | 0.13% | 0.35% | 0.13% |

μ = average of all measured data
G = scattering of measured data in Kp/cm²
V = *scattering of measured data in %*

Above tabulation discloses that the true data of the concrete reinforced by the indicated various fibres such as measured during the tests deviates surprisingly from the data to be expected by theoretical calculation.

The above example discloses further that a reinforcing of one m³ (35.3 cu. ft.) concrete with 144 kg (317.52 lbs) steel fibres and 1 kg (2.205 lbs) plastic fibre nets leads to a bending strength of 100 kp/cm² (1422 lbs/sq. in.), whereby the indicated amounts of the various fibres have been proven as giving optimal results.

Further tests were made including the following reinforcing elements: 67% "split fibres" (plastic fibres, in form of an open net), 29% plastic fibres in form of the above described closed net shape and 4% monofilaments of aramide fibres (Aramide=highly aromatic polyamide). This combination resulted in a doubling of the bending strength of the not reinforced concrete, thus again a figure not to be expected by theoretical calculation.

The tests made with the above specified embodiments reveal that a positively controlled uniform distribution of the individual reinforcing fibres leads to an unexpected improvement of the quality of the reinforced concrete.

Returning again to the not reinforced, pure concrete it further must be taken into consideration that the quality of the concrete depends also from the uniform distribution of the aggregates having various grain sizes. It is not only important how evenly one specific grain size (i.e. e.g. grain particles of a diameter of exclusively 5 mm) is dispersed within the poured concrete, it is also important which the relative amounts of grains of various sizes are.

It is generally known that the aggregates for the production of concrete must follow specific standard rules, among which the grain sizes are standardized. Specifically the curve of the grain sizes of the aggregates, i.e. the so-called grain-size curve (sieve-analysis curve) must be within specific limits and follow a specific shape or path, such as determined e.g. in Switzerland in Section 2.02 of the SIA (Swiss Engineer and Architects' Association) standards, which grain-size curve corresponds also to the DIN (German Engineering Standards) standard 1045 regarding the aggregates for concrete.

Figure 3:
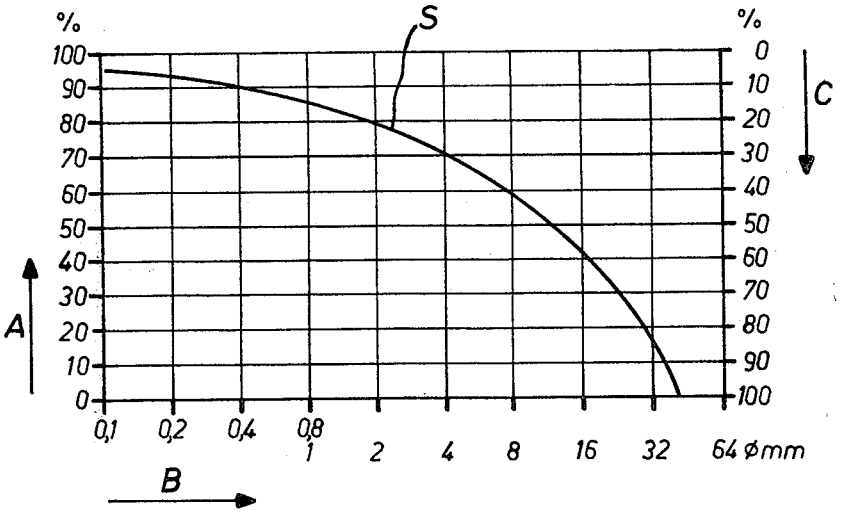
FIG. 3 is a standard grain-size curve for the aggregates for the production of concrete.

The sieve-analysis curve S, also termed grain-size curve and shown in FIG. 3, prescribes the distribution of the grain sizes expressed in percentages which is to be followed in accordance with the SIA standards.

In FIG. 3 "A" denotes the residue in weight percents, "B" denotes the mesh apertures, or circular hole width in millimeters, "C" denotes the passage in weight percents. For sake of completeness it must be mentioned that the curve S indicates mean values regarding allowable spreads, such as known by the person skilled in the art. (The corresponding curve S according to DIN standard 1045 is defined as "especially good".)

This grain size curve which has been determined by purely technical facts and knowledge defines thus the distribution of the amounts of the various grain sizes of the aggregates in percent, such to produce a (not reinforced) concrete structure of optimal quality.

It has now been realized that the same rule is applicable to the fibre reinforcement elements.

One of the features which must be paid attention to is the length of the fibres. Instead of using only one predetermined length of one type of fibres the fibres of the same type of material however comprising varying lengths are used, the length distribution being analogue to the grain size distribution of the aggregates. Thereby the distribution in percent of the various fibre lengths corresponds to the recognized law regarding the distribution of the grain sizes.

Figure 4:
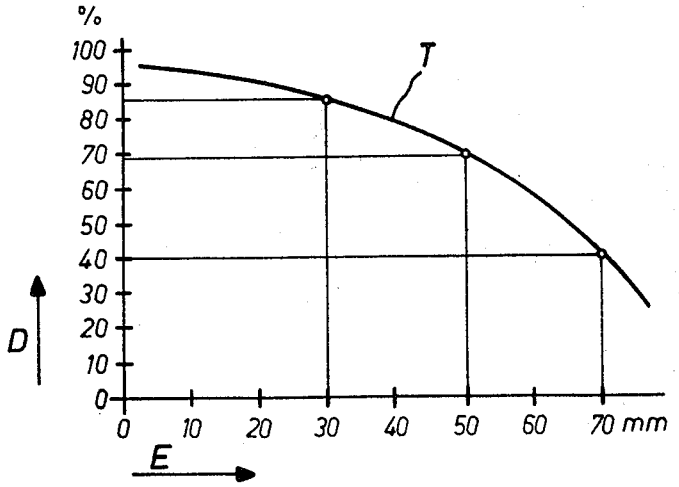
FIG. 4 is a diagram of the distribution of the amounts given in percents of various reinforcing fibres versus fibre length.

This is plotted in FIG. 4. Thereby "D" denotes the amount in % and "E" denotes the fibre length in millimeters. Curve T which extends geometrically identical to the grain size curve S of FIG. 3 can accordingly be identified as "length-grain-size curve". In accordance with this curve T an exemplary optimal fibre length distribution can be as follows:

| fibre length (mm) | relative amount in % |
|---|---|
| 0–30 | 14 |
| 30–50 | 18 |
| 50–70 | 28 |
| more than 70 | 40 |
| Total | 100 |

Referring now to the above embodiment incorporating the polypropylene fibre nets and the steel fibres this follows in using at the fibre net as well as the steel fibres various lengths. Thereby the relative distribution in percent of the amounts of each specific fibre length must follow the "length-grain-size curve" T such that the quality of the fibre reinforced concrete is improved further.

A further feature of the reinforcing fibres which must be paid attention to is the E-modulus, i.e. modulus of elasticity of the materials used to manufacture the fibres. The conclusion is that the reinforcing fibres must not only consist of the two above described (however quite successfully usable in practical application) groups of fibres. The polypropylene net is to be used together with steel fibres and/or glass fibres and/or carbon fibres and/or asbestos fibres and/or further plastic fibres as e.g. aramide.

Figure 5:
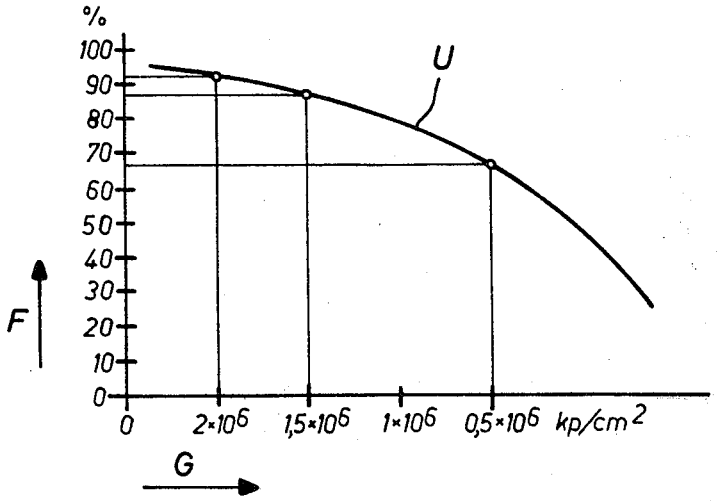
FIG. 5 is a diagram of the distribution of the amounts given in percents of various reinforcing fibres versus the modulus of elasticity.

Also in this case the known grain-size curve S according to FIG. 3 forms the basis of the distribution of the amounts in percent of the fibre reinforcing elements regarding their modulus of elasticity, such as drawn in FIG. 5. In FIG. 5 "F" denotes the amount in %, "G" denotes the modulus of elasticity in kp/cm², representing various materials and curve "U" corresponds again to curve S of FIG. 3. The diagram of FIG. 5 discloses that one optimal distribution of amounts of various reinforcing elements regarding the modulus of elasticity is the following:

| modulus of elasticity kp/cm² | amount in % |
|---|---|
| $\infty$–$2 \times 10^6$ | 8 |
| $2 \times 10^6$–$1.5 \times 10^6$ | 5 |

-continued

| modulus of elasticity kp/cm$^2$ | amount in % |
|---|---|
| $1.5 \times 10^6$–$0.5 \times 10^6$ | 20 |
| etc. | etc. |
| Total | 100% |

Accordingly, reinforcing fibres of the various materials must follow above interrelation.

In order to obtain an optimal reinforcement the interrelation of the distribution of amounts regarding the fibre length in accordance with curve "T" of FIG. 4 is to be combined with the interrelation of the distribution of amounts regarding the modulus of elasticity in accordance with curve "U" of FIG. 5. Conclusively, in order to obtain an optimal reinforcement predetermined amounts of fibres regarding fibre length and modulus of elasticity of the various materials must be chosen.

Because in any case at least one group of fibres in form of a fibre net is present, which fibre net distributes all individual fibres evenly during the mixing of concrete and prevents a balling up, the adding of any fibre material and any fibre length to the aggregates can be performed without any special expenditures or procedures. No unrealistic or impracticable procedures of adding the fibres and no specific mixing time spans must be paid attention to.

Following, two embodiments of adding the reinforcing fibres will be described.

Generally fibres are manufactured in that (e.g. for plastic fibres) a foil is partitioned or cut, respectively, such that either the closed fibre net, open fibre nets or individual fibres are produced or in that (e.g. for steel fibres or glass fibres) continuously fabricated (drawn, extruded) wires are cut. In accordance with an already known procedure for plastic fibres the plastic structures can be twisted or twined, respectively, prior to the cutting for producing the fibres having a predetermined length (the filaments are twisted or adhered to one another by binding agents prior to the cutting) such that with regard to the material various cord-like structures are produced. All these cord-like structures are thereafter twisted together once more, such to produce a thicker compound cord comprising several different materials, which compound cord is finally cut into individual sections. Depending from the specific material used these cord sections retain their shape due to the pre-tensioning, the friction generated during the twisting or use is made of water soluble binding agents. Thereby the number of twists, the material used as bonding agent etc. is predetermined by means of tests and chosen such that the reinforcing cords can be charged together with the aggregates into the concrete mixer and such that after termination of the standard time span for the mixing of concrete the reinforcing fibres are uniformly dispersed across the cross section of the reinforced concrete due to the always present self-distributing fibre net.

According to a further embodiment at which the concrete to be poured is fed in a known way through a pressure tube only the closed fibre nets are fed together with the aggregates to the concrete mixing machine. Immediately ahead of the end of the pressure tube the other individual reinforcing fibres are added to the concrete stream, this also in a known way by utilizing an ejector type arrangement. Also in this case the uniform distribution of the individual fibres is secured because the fibre nets prevent a balling, a sinking or floating up of the individual fibres.

Although the above description of preferred embodiments refers to the production of a reinforced concrete structure it shall distinctly be noted that the described fibre reinforcement is as well applicable for the production of tar- and bituminous pavements in order to prevent the formation of large cracks and to form a crack pattern having fine cracks, into which cracks water cannot penetrate and freeze, such that frost damages of roads etc. can be prevented to a large extent.

While there are shown and described present preferred embodiments of the invention, it is to be distinctly understood that the invention is not limited thereto, but may be otherwise variously embodied and practiced within the scope of the following claims. Accordingly,

What is claimed is:

1. A fibrous reinforcing means for structures and coatings of the type selectively bound together by cement and by bitumen comprising at least two different fiber forms, one of said fiber forms being a closed fiber net including spring elastic fiber means, said closed fiber net having a condensed form prior to being added to a material with which it is mixed and said spring elastic fiber means being means urging said closed fiber net to an open form, said closed fiber net including a first group of fibers and a second group of fibers, said second group of fibers defining said spring elastic fiber means, the fibers of said first group having a length different from the length of the fibers of said second group, and said fiber forms each comprising fibers of various lengths for distribution in the mixing material in a percentage equivalent in the intended distribution percentage of mixing material aggregates of different grain sizes.

2. The fibrous reinforcing means of claim 1 wherein the fibers of said fiber forms exhibit various moduli of elasticity.

3. The fibrous reinforcing means of claim 1 wherein said closed fiber net has polypropylene fibers and said second fiber form is a group of steel fibers.

4. The fibrous reinforcing means of claim 3 wherein said closed fiber net further includes glass fibers and/or steel fibers and/or plastic fibers and/or carbon fibers and/or asbestos fibers and/or natural fibers.

5. The fibrous reinforcing means of claim 1 wherein in the state prior to the adding to the materials to be mixed all of said fiber forms are joined together.

6. The fibrous reinforcing means of claim 5 wherein all of said fiber forms are twisted with each other.

* * * * *